US010555557B2

(12) United States Patent
Liu

(10) Patent No.: US 10,555,557 B2
(45) Date of Patent: Feb. 11, 2020

(54) ELECTRONIC CIGARETTE AND METHOD FOR CONTROLLING HEATING AND ATOMIZATION THEREOF

(71) Applicant: Shenzhen Smoore Technology Limited, Shenzhen, Guangdong (CN)

(72) Inventor: Pingkun Liu, Guangdong (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 284 days.

(21) Appl. No.: 15/740,819

(22) PCT Filed: Oct. 26, 2015

(86) PCT No.: PCT/CN2015/089264
§ 371 (c)(1),
(2) Date: Dec. 29, 2017

(87) PCT Pub. No.: WO2017/041251
PCT Pub. Date: Mar. 16, 2017

(65) Prior Publication Data

US 2018/0184715 A1 Jul. 5, 2018

(30) Foreign Application Priority Data

Sep. 9, 2015 (CN) ..... 2015 1 0572097

(51) Int. Cl.
*A24F 47/00* (2006.01)
*H05B 1/02* (2006.01)
*H05B 3/00* (2006.01)

(52) U.S. Cl.
CPC ..... *A24F 47/008* (2013.01); *A24F 47/00* (2013.01); *H05B 1/0297* (2013.01); *H05B 3/0014* (2013.01); *H05B 2203/021* (2013.01)

(58) Field of Classification Search
CPC ..... A24F 47/008
See application file for complete search history.

(56) References Cited

U.S. PATENT DOCUMENTS 5,723,184 A * 3/1998 Yamamoto ..... A01M 17/008 118/300
10,327,479 B2 * 6/2019 Popplewell ..... G05B 13/024
(Continued)

FOREIGN PATENT DOCUMENTS

CN 104116138 B 10/2017

*Primary Examiner* — James Harvey
(74) *Attorney, Agent, or Firm* — Hemisphere Law, PLLC; Zhigang Ma

(57) ABSTRACT

An electronic cigarette and a method for controlling heating and atomization of electronic cigarette are provided. The electronic cigarette includes a power supply device (1), a heating element (2) and a control device (3). The control device (3) includes a storage module (35) storing a plurality of temperature variation parameters corresponding to a plurality of temperature variation curves and a plurality of preferable atomization temperatures corresponding to a plurality types of liquid solutions; a temperature detection module (31) for detecting a temperature variation of the heating element (2); and a control module (32) comparing the temperature variation parameters of the heating element (2) detected by the temperature detection module (31) with the temperature variation parameters stored in the storage module (35), obtaining the preferable atomization temperature of the liquid solution, and controlling the heating of the liquid solution by the heating element at the corresponding preferable atomization temperature.

16 Claims, 2 Drawing Sheets

(56) References Cited

U.S. PATENT DOCUMENTS

| | | | | |
|---|---|---|---|---|
| 2017/0079323 | A1* | 3/2017 | Wang | H01M 10/4257 |
| 2017/0164658 | A1* | 6/2017 | Lin | A61M 15/06 |
| 2018/0184715 | A1* | 7/2018 | Liu | A24F 47/00 |
| 2019/0124992 | A1* | 5/2019 | Nakano | A24F 47/00 |

* cited by examiner

ELECTRONIC CIGARETTE AND METHOD FOR CONTROLLING HEATING AND ATOMIZATION THEREOF

TECHNICAL FIELD

The present disclosure relates to substitutes for cigarettes, and more particularly, to an electronic cigarette and a method for controlling heating and atomization thereof.

BACKGROUND

Electronic cigarettes, also known as virtual cigarettes, smell like actual cigarettes and thus are capable of simulating the feeling of smoking without affecting the smoker's health. Electronic cigarettes are generally used as products helping the smoker to quit smoking and as substitutes for cigarettes.

However, as a voltage or power outputted by a power supply component of the electronic cigarette gradually increases and a resistance of a heating element of an atomization assembly of the electronic cigarettes becomes smaller and smaller, the temperature of the heating element gets higher and higher. An excessively high temperature of the heating element may cause liquid solution to release harmful substance, affecting people's opinion towards the electronic cigarette.

In addition, since different types of liquid solutions have different ingredients, atomization temperatures corresponding to optimum smoking feelings of these types of liquid solutions are also accordingly different.

Technical Problem

The technical problem solved by the present disclosure is to provide an improved electronic cigarette and a method for controlling heating and atomization thereof.

SUMMARY OF THE DISCLOSURE

An improved electronic cigarette and a method for controlling heating and atomization of the electronic cigarette are disclosed.

According to one aspect of the present disclosure, an electronic cigarette is provided, including a power supply device, a heating element and a control device;

the control device is electrically connected with the power supply device and the heating element respectively, and the power supply device supplies electric energy to the control device and the heating element;

the control device includes:

a storage module storing a plurality of temperature variation parameters corresponding to a plurality of temperature variation curves, wherein each temperature variation curve shows a temperature variation of the heating element when a liquid solution is heated with a first power, and the storage module also stores a plurality of preferable atomization temperatures corresponding to a plurality types of liquid solutions;

a temperature detection module for detecting a temperature variation of the heating element; and a control module comparing the temperature variation parameters of the heating element detected by the temperature detection module with the temperature variation parameters stored in the storage module, obtaining, if the type of the detected liquid solution is one of types of the liquid solution stored in the storage module, the preferable atomization temperature of the liquid solution, and controlling the heating of the liquid solution by the heating element at the corresponding preferable atomization temperature.

In an embodiment, a predetermined voltage or power is provided to the heating element to heat and atomize the liquid solution if the type of the detected liquid solution is not one of the types of the liquid solution stored in the storage module.

In an embodiment, the heating element is made of material of temperature coefficient of resistance, and the control device obtains the temperature of the heating element from a resistance of the heating element.

In an embodiment, the heating element is made of one or more material selected from platinum, copper, nickel, titanium, iron, ceramic-based PTC material, and polymer-based PTC material, and the resistance of the heating element increases with the temperature of the heating element.

In an embodiment, the temperature detection module includes a voltage detection element and a current detection element for detecting a voltage and a current of the heating element, respectively.

In an embodiment, the preferable atomization temperatures include a plurality of atomization temperatures or a plurality of atomization temperature ranges.

In an embodiment, the temperature detection module includes a temperature sensor for detecting the temperature variation of the heating element.

According to another aspect of the present disclosure, a method for controlling heating and atomization of an electronic cigarette is provided; wherein the electronic cigarette stores a plurality of temperature variation parameters corresponding to a plurality of temperature variation curves; each temperature variation curve shows a temperature variation of the heating element when a liquid solution is heated with a first power, and the electronic cigarette also stores a plurality of preferable atomization temperatures corresponding to a plurality types of liquid solutions; the method includes following steps:

A, heating the liquid solution with the first power and detecting a temperature variation of the heating element, and comparing the temperature variation parameters of the heating element with the temperature variation parameters stored in the storage module;

B, obtaining, if the type of the detected liquid solution is one of types of the liquid solution stored in the storage module, the preferable atomization temperature of the liquid solution; and C, heating the liquid solution by the heating element under the control of the control device at the corresponding preferable atomization temperature.

In an embodiment, the method further includes: providing a predetermined voltage or power to the heating element to heat and atomize the liquid solution if the type of the detected liquid solution is not one of the types of liquid solution stored in the storage module.

In an embodiment, the preferable atomization temperatures include a plurality of atomization temperatures or a plurality of atomization temperature ranges.

In the electronic cigarette and method for controlling heating and atomization of the same provided in the present disclosure, the control device obtains the temperature of the heating element after the heating element has been heating for a time period, and determines the ingredients of the liquid solution heating by the heating element through the temperature, and thus controls the heating of the liquid solution by the heating element at the corresponding preferable atomization temperature, ensuring the flavor and smoke volume of the atomization of the liquid solution and thus improving the user experience.

BRIEF DESCRIPTION OF THE DRAWINGS

The present disclosure will be described in more detail with reference to the accompany drawings and the embodiments, wherein in the drawings.

PREFERRED EMBODIMENTS

For clearly understanding technical features, purpose, and effect of the present disclosure, embodiments are given in detail hereinafter with reference to the accompanying drawings.

Figure 1:
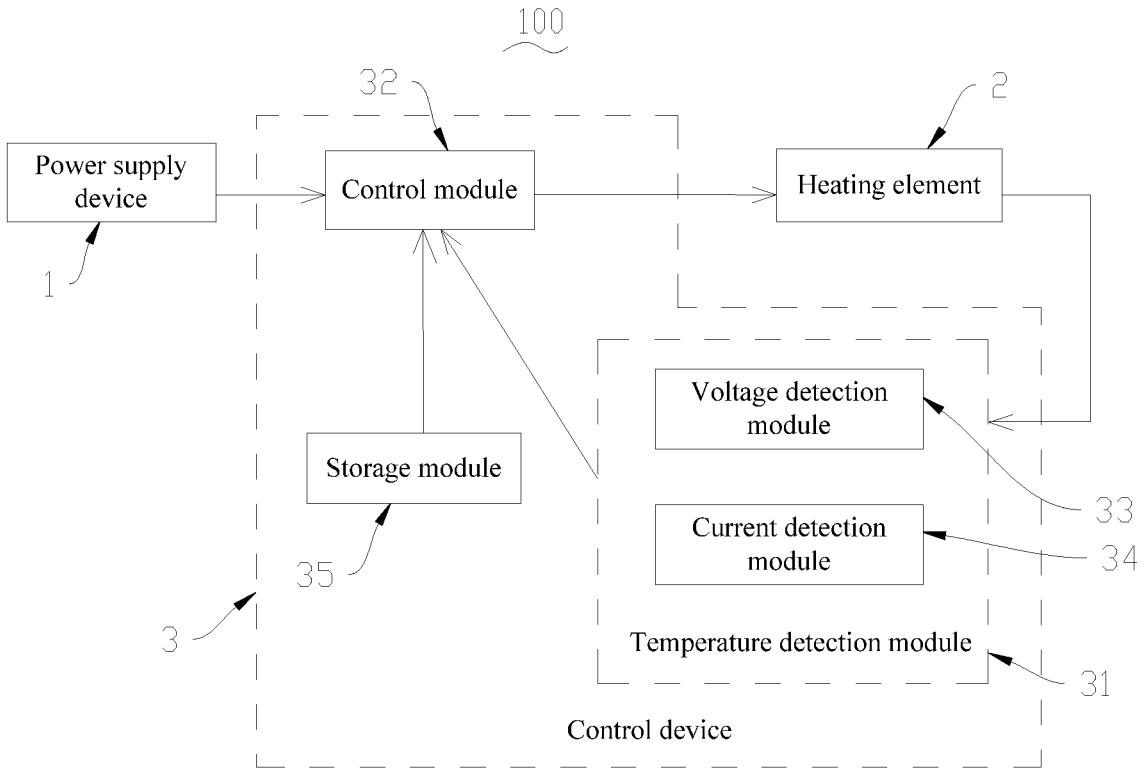
FIG. 1 is a circuit schematic diagram of an electronic cigarette in accordance with a first embodiment of the present disclosure.

Referring to FIG. 1, an electronic cigarette 100 in accordance with a first embodiment of the present disclosure includes a power supply device 1, a heating element 2, and a control device 3. The control device 3 is electrically connected with the power supply device 1 and the heating element 2 respectively. The power supply device 1 supplies power to the control device 3 and the heating element 2.

The main ingredients of liquid solution are glycerol and propanediol. However, boiling points of glycerol and propanediol differ from each other greatly, and a specific heat capacity of glycerol is also different from that of propanediol. For different liquid solutions, due to different ratios of glycerol and propanediol, even when the liquid solutions are heated by a same heating element with a same power, temperature variation curves of the heating element may be different due to different ingredients of the liquid solutions. Also, liquid solutions having different ingredients may have different preferable atomization temperatures. The preferable atomization temperature herein can be the atomization temperature corresponding to a preferable taste or the atomization temperature corresponding to a preferable taste and a smoke volume. The preferable atomization temperature of each type of liquid solution can be determined by a cigarette taster after tasting the liquid solution atomized at different temperatures. For example, peppermint-flavored liquid solution, fruit-flavored liquid solution, tobacco-flavored liquid solution may have different preferable atomization temperatures.

In order to enable the smokers to have preferable feelings such as tastes and/or smoke volumes when smoking liquid solutions of different ingredients, the control device 3 stores a plurality of temperature variation parameters corresponding to a plurality of temperature variation curves. Each temperature variation curve shows the temperature variation of the heating element 2 when one type of liquid solution is heated by the heating element 2 with a first power. The temperature variation parameters can include a temperature at a time T and a temperature variation speed at the time T, etc. T can be the time point after the electronic cigarette has been heated for 200 or 300 milliseconds.

The temperature variation parameters of the heating element 2 in the atomizations of different liquid solutions stored in the control device 3 are pre-measured before the electronic cigarette leaves the factory and are recorded into the control device 3. Since the temperature variation parameters are associated with the corresponding heating element 2, thus, in the process of determining the type of the liquid solution according to the parameters, the used heating element 2 needs to correspond to the recorded temperature variation parameters.

The electronic cigarette can be a disposable one or a chargeable one. When the electronic cigarette is a disposable one, since an atomization assembly and the power supply device are integrally formed in a house, and the atomization assembly corresponds to the power supply device, thus, it is unnecessary to match the atomization assembly with the power supply device 1. When the electronic cigarette is a chargeable one, since the atomization assembly is generally detachably connected to the power supply device 1, thus, the atomization assembly mounted to the power supply device 1 is required to be the original one, or, the atomization assembly mounted to the power supply device 1 is required to have the same heating element 2 as the original atomization assembly.

In addition, the control device 3 stores a plurality of preferable atomization temperatures corresponding to different types of liquid solutions. The preferable atomization temperatures herein may include a plurality of atomization temperatures or a plurality of atomization temperature ranges.

The heating element 2 is made of material of temperature coefficient of resistance. The control device 3 obtains the temperature of the heating element 2 through a resistance of the heating element 2. In some embodiments, the heating element 2 is made of one or two or more than two materials selected from platinum, copper, nickel, titanium, iron, ceramic-based PTC material and polymer-based PTC material, and the resistance of the material increases as the temperature of the heating element 2 increases.

The control device 3 includes a control module 32, a voltage detection element 33, a current detection element 34, and a storage module 35. The voltage detection element 33 and the current detection element 34 form a temperature detection module 31. The voltage detection element 33 and the current detection element 34 are connected to the heating element 2 to detect a voltage and a current of the heating element 2. Since the heating element 2 is made of material of temperature coefficient of resistance, the control module 32 can obtain the temperature variation parameters of the heating element 2 according to the detection data from the temperature detection module 31, and thus obtains the type of the currently-heated liquid solution and controls the heating of the liquid solution at the corresponding preferable atomization temperature. The process of controlling the heating element 2 at a preferable atomization temperature can be found in the published Chinese Application NO. CN201410289154.7 for reference.

The storage module 35 stores the plurality of temperature variation parameters corresponding to the plurality of temperature variation curves. Each temperature variation curve shows the temperature variation of the heating element 2 when one type of liquid solution is heated by the heating element 2 with the first power. The storage module 35 further stores the plurality of preferable atomization temperatures corresponding to different types of liquid solutions.

Figure 2:
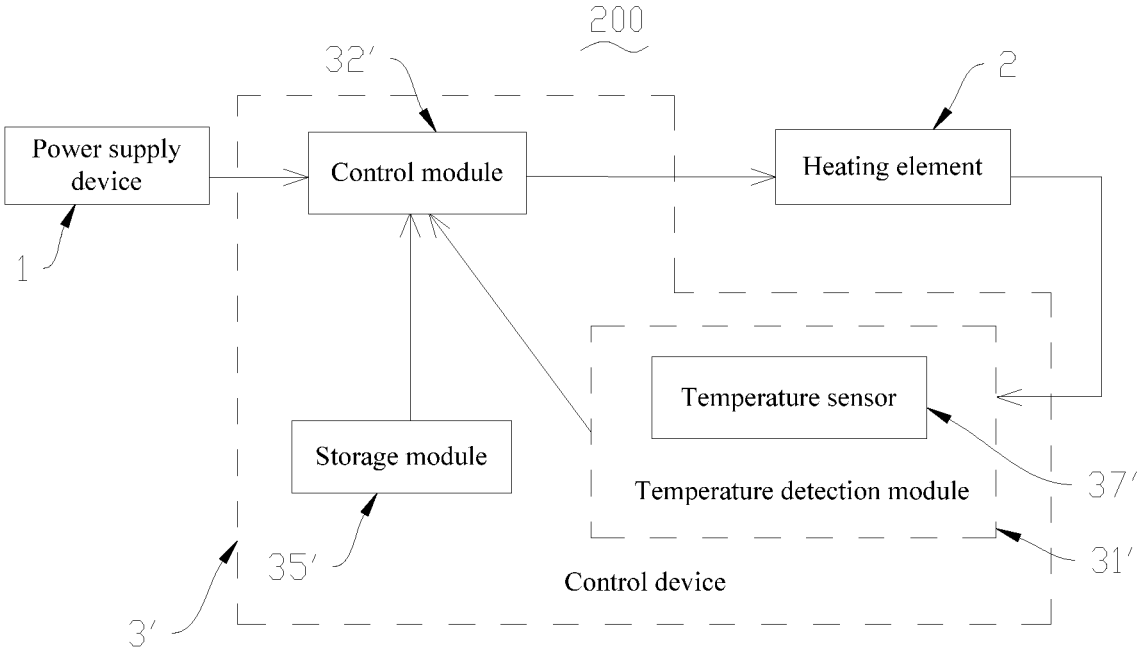
FIG. 2 is a circuit schematic diagram of an electronic cigarette in accordance with a second embodiment of the present disclosure.
Figure 3:
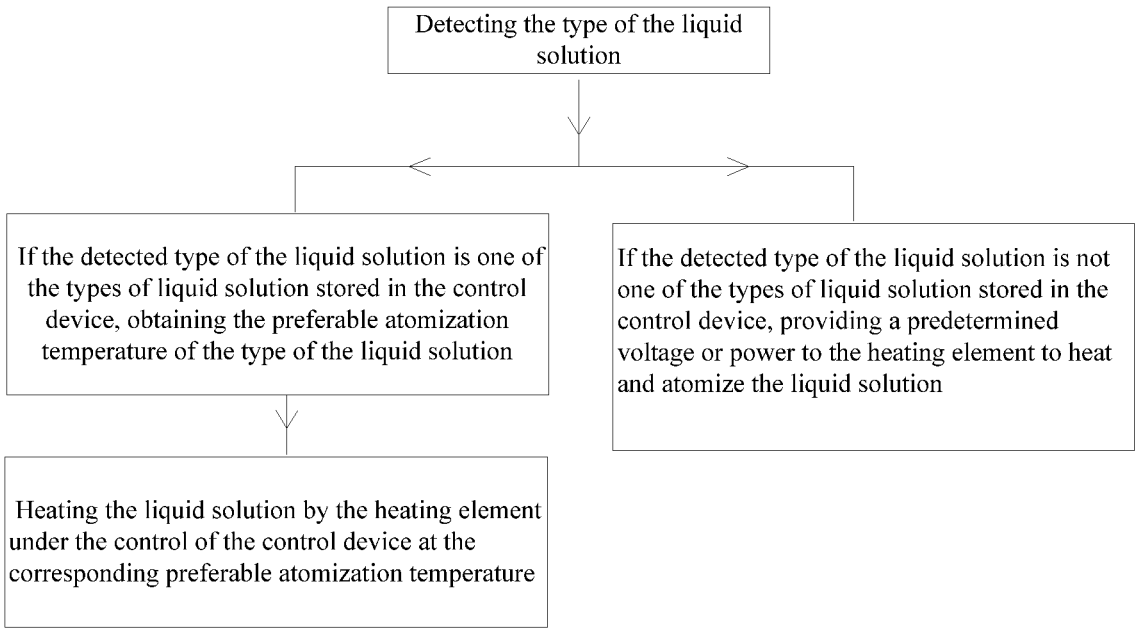
FIG. 3 is a flow chart illustrating processes of a method for controlling heating and atomization of an electronic cigarette in accordance with an embodiment of the present disclosure.

Referring to FIG. 2, in a second embodiment, the heating element 2 can be made of conventional heating material. The difference between the electronic cigarette 200 of the second embodiment and that of the first embodiment lies in that, the heating element 2 is made of material of temperature coefficient of non-resistance, the control device 3' includes a control module 32', a storage module 35', and a temperature detection module 31', and the temperature detection module 31' includes a temperature sensor 37'. The temperature sensor 37' is configured detecting the temperature of the heating element 2. The control module 32' obtains the type of the current liquid solution being heated according to each temperature variation parameter of the heating element 2, and controls the heating of the liquid solution at a preferable temperature corresponding to the type of the liquid solution. The process of controlling the heating element 2 at a preferable atomization temperature can be found in the published Chinese Application NO. CN201410289154.7 for reference.

In an embodiment, a method for controlling heating and atomization of the electronic cigarette includes steps as follows.

Step A, detecting the type of the liquid solution. After being turned on, the electronic cigarette supplies power to the heating element 2 with a first power (being equal to the preset power in the measurement before the electronic cigarette leaves factory) and detects each temperature variation parameter of the heating element 2, thereby obtaining the type of current liquid solution being heated, for example, the current liquid solution has a minty flavor or a Tabaco flavor.

By comparing the detected temperature variation parameters with the temperature variation parameters of the multiple temperature variation curves stored in the control device 3, the electronic cigarette can obtain the type of the liquid solution. It is understood that if the type of the liquid solution being heated by the electronic cigarette is not one of the multiple types of liquid solution stored in the control device 3, the control device 3 may be unable to search the type of the liquid solution. The table of the temperature variation parameters stored in the control device may be exemplarily as follows:

| | Temperature variation parameters of heating element 2 | | Preferable |
|---|---|---|---|
| Type of liquid solution | Temperature at 100 ms | Temperature at 200 ms | atomization temperature |
| Liquid solution of minty flavor | 100 | 150 | 190 |
| Liquid solution of Tabaco flavor | 120 | 180 | 200 |

The temperature in the above table is measured in Celsius. It is understood that the data in the above table is only exemplary for illustration, and in actual measurements, the temperature may be affected by the resistance of the heating element 2 and the heating power and so on. Moreover, the liquid solutions of the same type can be classified into liquid solutions of sub-types, for example, the liquid solution of Tabaco flavor produced by the Marlboro Company has different ingredients from that of Tabaco flavor produced by the Camel Company.

When the heating element 2 is made of material of temperature coefficient of non-resistance, the control device 3 can obtain the temperature of the heating element 2 according to the resistance of the heating element 2.

Step B, if the detected type of the liquid solution is one of the types of liquid solution stored in the control device 3, obtaining the preferable atomization temperature of the type of the liquid solution.

Step C, heating the liquid solution by the heating element 2 under the control of the control device 3 at the corresponding preferable atomization temperature.

Step D, if the detected type of the liquid solution is not one of the types of liquid solution stored in the control device 3, providing a predetermined voltage or power to the heating element 2 to heat and atomize the liquid solution.

It is understood that the above technical features can be provided in any combination without limitation.

The contents described above are only preferred embodiments of the present disclosure, but the scope of the present disclosure is not limited to the embodiments. Any ordinarily skilled in the art would make any modifications or replacements to the embodiments in the scope of the present disclosure, and these modifications or replacements should be included in the scope of the present disclosure. Thus, the scope of the present disclosure should be subjected to the claims.

What is claimed is:

1. An electronic cigarette, wherein the electronic cigarette comprises a power supply device (1), a heating element (2) and a control device (3);

the control device (3) is electrically connected with the power supply device (1) and the heating element (2) respectively, and the power supply device (1) supplies electric energy to the control device (3) and the heating element (2);

the control device (3) comprises:

a storage module storing a plurality of temperature variation parameters corresponding to a plurality of temperature variation curves, wherein each temperature variation curve shows a temperature variation of the heating element (2) when a liquid solution is heated with a first power, and the storage module also stores a plurality of preferable atomization temperatures corresponding to a plurality types of liquid solutions;

a temperature detection module for detecting a temperature variation of the heating element (2); and a control module comparing the temperature variation parameters of the heating element (2) detected by the temperature detection module with the temperature variation parameters stored in the storage module, obtaining, if the type of the detected liquid solution is one of types of the liquid solution stored in the storage module, the preferable atomization temperature of the liquid solution, and controlling the heating of the liquid solution by the heating element (2) at the corresponding preferable atomization temperature.

2. The electronic cigarette of claim 1, wherein a predetermined voltage or power is provided to the heating element (2) to heat and atomize the liquid solution if the type of the detected liquid solution is not one of the types of the liquid solution stored in the storage module.

3. The electronic cigarette of claim 1, wherein the heating element (2) is made of material of temperature coefficient of resistance, and the control device (3) obtains the temperature of the heating element (2) from a resistance of the heating element (2).

4. The electronic cigarette of claim 3, wherein the heating element (2) is made of one or more material selected from platinum, copper, nickel, titanium, iron, ceramic-based PTC material, and polymer-based PTC material, and the resistance of the heating element (2) increases with the temperature of the heating element (2).

5. The electronic cigarette of claim 3, wherein the temperature detection module comprises a voltage detection element (33) and a current detection element (34) for detecting a voltage and a current of the heating element (2), respectively.

6. The electronic cigarette of claim 1, wherein the preferable atomization temperatures comprise a plurality of atomization temperatures or a plurality of atomization temperature ranges.

7. The electronic cigarette of claim 1, wherein the temperature detection module comprises a temperature sensor (37') for detecting the temperature variation of the heating element (2).

8. A method for controlling heating and atomization of an electronic cigarette, wherein the electronic cigarette stores a plurality of temperature variation parameters corresponding to a plurality of temperature variation curves; each temperature variation curve shows a temperature variation of the heating element (2) when a liquid solution is heated with a first power, and the electronic cigarette also stores a plurality of preferable atomization temperatures corresponding to a plurality types of liquid solutions; the method comprises following steps:

A, heating the liquid solution with the first power and detecting a temperature variation of the heating element (2), and comparing the temperature variation parameters of the heating element (2) with the temperature variation parameters stored in the storage module;

B, obtaining, if the type of the detected liquid solution is one of types of the liquid solution stored in the storage module, the preferable atomization temperature of the liquid solution; and C, heating the liquid solution by the heating element (2) under the control of the control device (3) at the corresponding preferable atomization temperature.

9. The method of claim 8, further comprising: providing a predetermined voltage or power to the heating element (2) to heat and atomize the liquid solution if the type of the detected liquid solution is not one of the types of liquid solution stored in the storage module.

10. The method of claim 8, wherein the preferable atomization temperatures comprise a plurality of atomization temperatures or a plurality of atomization temperature ranges.

11. The electronic cigarette of claim 2, wherein the heating element (2) is made of material of temperature coefficient of resistance, and the control device (3) obtains the temperature of the heating element (2) from a resistance of the heating element (2).

12. The electronic cigarette of claim 2, wherein the preferable atomization temperatures comprise a plurality of atomization temperatures or a plurality of atomization temperature ranges.

13. The electronic cigarette of claim 2, wherein the temperature detection module comprises a temperature sensor (37') for detecting the temperature variation of the heating element (2).

14. The electronic cigarette of claim 11, wherein the heating element (2) is made of one or more material selected from platinum, copper, nickel, titanium, iron, ceramic-based PTC material, and polymer-based PTC material, and the resistance of the heating element (2) increases with the temperature of the heating element (2).

15. The electronic cigarette of claim 11, wherein the temperature detection module comprises a voltage detection element (33) and a current detection element (34) for detecting a voltage and a current of the heating element (2), respectively.

16. The method of claim 9, wherein the preferable atomization temperatures comprise a plurality of atomization temperatures or a plurality of atomization temperature ranges.

* * * * *